US009925547B2

(12) United States Patent
Scheckman et al.

(10) Patent No.: US 9,925,547 B2
(45) Date of Patent: Mar. 27, 2018

(54) ELECTROSPRAY WITH SOFT X-RAY NEUTRALIZER

(71) Applicant: TSI, Inc., Shoreview, MN (US)

(72) Inventors: Jacob Hackbarth Scheckman, Minneapolis, MN (US); Frederick Quant, Shoreview, MN (US); Tony Hase, White Bear Township, MN (US)

(73) Assignee: TSI, Incorporated, St. Paul, MN (US)

( * ) Notice: Subject to any disclaimer, the term of this patent is extended or adjusted under 35 U.S.C. 154(b) by 181 days.

(21) Appl. No.: 14/835,990

(22) Filed: Aug. 26, 2015

(65) Prior Publication Data

US 2016/0059249 A1 Mar. 3, 2016

Related U.S. Application Data

(60) Provisional application No. 62/041,832, filed on Aug. 26, 2014.

(51) Int. Cl.
*B05B 5/00* (2006.01)
*B05B 5/03* (2006.01)

(52) U.S. Cl.
CPC ..... *B05B 5/002* (2013.01); *B05B 5/03* (2013.01)

(58) Field of Classification Search
CPC ..... B05B 5/002; B05B 5/003; B05B 5/004
USPC ..... 239/690–708; 250/281–300
See application file for complete search history.

(56) References Cited

U.S. PATENT DOCUMENTS 3,130,067 A * 4/1964 Bulgin ..... B01J 19/081 427/472
3,226,543 A * 12/1965 Melzner ..... H01J 49/406 250/287
3,683,212 A * 8/1972 Zoltan ..... B41J 2/04541 261/DIG. 48
3,857,049 A * 12/1974 Zoltan ..... B41J 2/04541 310/328
4,357,536 A * 11/1982 Varma ..... G01T 1/29 250/397
4,383,171 A * 5/1983 Sinha ..... G01N 30/72 250/282
4,546,253 A * 10/1985 Tsuchiya ..... H01J 49/168 250/281
4,735,364 A * 4/1988 Marchant ..... B05B 5/043 239/690.1
4,761,545 A * 8/1988 Marshall ..... H01J 49/38 250/282

(Continued)

OTHER PUBLICATIONS

Liu et al., "An electrospray aerosol generator with X-ray photoionizer for particle charge reduction", Journal of Aerosol Science, vol. 76, pp. 148-162 (Oct. 2014).

(Continued)

*Primary Examiner* — Viet Le
(74) *Attorney, Agent, or Firm* — Kagan Binder, PLLC

(57) ABSTRACT

The electrospray generator system described herein uses a soft X-ray source instead of a radioactive source to generate bipolar ions for the neutralization of the initially charged particles. In one example, the soft X-ray source is directed at an orifice from which the charged particles emanate, thereby allowing the neutralization of the particles to happen faster than in prior art configurations and, in some instances, even neutralization occurring immediately on a droplet before it passes through the electrospray orifice.

10 Claims, 6 Drawing Sheets

(56) References Cited

U.S. PATENT DOCUMENTS 4,845,512 A * 7/1989 Arway ..... B41J 2/09 239/690
4,883,958 A * 11/1989 Vestal ..... G01N 30/7273 250/281
4,960,991 A * 10/1990 Goodley ..... H01J 27/08 250/281
4,999,493 A * 3/1991 Allen ..... G01N 30/7266 250/282
5,076,097 A * 12/1991 Zarrin ..... G01N 30/62 73/61.72
5,192,865 A * 3/1993 Zhu ..... H01J 49/04 250/281
5,247,842 A * 9/1993 Kaufman ..... B05B 5/002 356/37
5,504,327 A * 4/1996 Sproch ..... H01J 49/165 250/281
5,608,217 A * 3/1997 Franzen ..... G01N 30/7266 250/281
5,663,561 A * 9/1997 Franzen ..... H01J 49/0463 250/282
5,750,988 A * 5/1998 Apffel ..... H01J 49/165 250/288
5,811,800 A * 9/1998 Franzen ..... H01J 49/422 250/282
5,814,368 A * 9/1998 Yamada ..... B05B 5/002 118/308
5,873,523 A * 2/1999 Gomez ..... A61M 15/02 239/3
5,880,466 A * 3/1999 Benner ..... H01J 49/027 250/281
5,922,976 A * 7/1999 Russell ..... G01N 15/02 73/865.5
5,925,732 A * 7/1999 Ecker ..... B01J 19/0046 422/131
5,992,244 A * 11/1999 Pui ..... B01J 19/081 73/865.5
6,074,135 A * 6/2000 Tapphorn ..... B05B 5/047 406/134
6,107,628 A * 8/2000 Smith ..... H01J 49/066 250/292
6,147,345 A * 11/2000 Willoughby ..... B05B 5/0255 250/281
6,265,466 B1 * 7/2001 Glatkowski ..... G21F 1/10 523/137
6,331,330 B1 * 12/2001 Choy ..... B05D 1/04 427/314
6,331,702 B1 * 12/2001 Krutchinsky ..... H01J 49/04 250/281
6,679,441 B1 * 1/2004 Borra ..... B05B 5/0255 239/690
6,727,471 B2 * 4/2004 Evans ..... E01C 11/265 219/213
6,739,530 B1 * 5/2004 Shilton ..... H05F 3/06 239/590.3
6,815,668 B2 * 11/2004 Miller ..... G01N 27/624 250/281
6,828,572 B2 * 12/2004 Reece ..... H01J 37/244 250/491.1
7,022,981 B2 * 4/2006 Kato ..... H01J 49/0045 250/281
7,259,109 B2 * 8/2007 Meagley ..... B05B 5/0255 257/E21.487
7,282,705 B2 * 10/2007 Brennen ..... B81B 1/00 137/827
7,518,108 B2 * 4/2009 Frey ..... H01J 49/0045 250/281
7,522,703 B2 4/2009 Okuyama et al.
7,796,727 B1 * 9/2010 Kaufman ..... H05F 3/06 378/64
7,839,145 B2 * 11/2010 Cornwell ..... G01R 33/4808 324/307
8,039,795 B2 * 10/2011 Mordehai ..... H01J 49/167 250/281
8,079,832 B2 * 12/2011 Bergaud ..... B01L 3/0244 239/696
8,181,505 B2 * 5/2012 Mertler ..... G01N 15/0266 250/281
8,368,012 B2 * 2/2013 Nikolaev ..... H01J 37/248 250/281
9,200,987 B2 * 12/2015 Bartko ..... G01N 1/2202
9,449,736 B2 * 9/2016 Koslow
9,681,531 B2 * 6/2017 Gall ..... H05H 13/02
2001/0035494 A1 * 11/2001 Scalf ..... H01J 49/165 250/288
2002/0085977 A1 * 7/2002 Fotland ..... B05B 5/007 424/45
2002/0113151 A1 * 8/2002 Forber Jones ..... B01J 2/02 239/690
2002/0125423 A1 * 9/2002 Ebeling ..... H01J 49/044 250/288
2002/0166958 A1 * 11/2002 Afeyan ..... G01N 30/72 250/282
2003/0226750 A1 * 12/2003 Fenn ..... B05B 5/002 204/164
2006/0060769 A1 * 3/2006 Bousse ..... B05B 5/025 250/282
2006/0255261 A1 * 11/2006 Whitehouse ..... H01J 49/0431 250/288
2006/0267156 A1 * 11/2006 Meagley ..... B05B 5/0255 257/632
2008/0248416 A1 * 10/2008 Norikane ..... B01J 2/04 430/137.18
2009/0266516 A1 * 10/2009 Jewell-Larsen ..... B05B 5/0255 165/84
2011/0163176 A1 * 7/2011 Yamaguchi ..... A23N 12/023 239/3
2011/0210181 A1 * 9/2011 Edinger ..... C23F 4/00 239/3
2014/0021268 A1 * 1/2014 Rasa ..... B01D 5/0072 239/3
2014/0034759 A1 * 2/2014 Yabu ..... G03F 7/2004 239/708
2014/0076988 A1 * 3/2014 Rasa ..... B41J 2/04515 239/13
2016/0059249 A1 * 3/2016 Scheckman ..... B05B 5/03 239/690
2016/0107178 A1 * 4/2016 Velasquez-Garcia ..... B05B 1/14 239/3
2016/0175881 A1 * 6/2016 Lasch ..... B05D 1/06 427/475

OTHER PUBLICATIONS

Modesto-Lopez et al., "Soft X-ray charger (SXC) system for use with electrospray for mobility measurement of bioaerosols", Journal of Electrostatics, vol. 69, Issue 4, pp. 357-364 (Aug. 2011).

* cited by examiner

X= 1.4/(.225/.01-1) = 1.4/21.5 = 0.065
Y= 1.465
Θ= ARCAN(0.225/1.465 = 0.152
Z= 2*(.258+.048)*TAN(0.204) = 0.10

ELECTROSPRAY WITH SOFT X-RAY NEUTRALIZER

PRIORITY CLAIM

The present nonprovisional patent application claims the benefit of and priority, under 35 USC § 119(e), from U.S. Provisional Patent Application No. 62/041,832, filed on Aug. 26, 2014, entitled "ELECTROSPRAY WITH SOFT X-RAY NEUTRALIZER," the entirety of which is incorporated herein by reference.

FIELD AND BACKGROUND OF THE INVENTION

The invention generally relates to electrospray aerosol generators.

A prior art charge-neutralized electrospray aerosol generator is disclosed by Kaufman et al., in U.S. Pat. No. 5,247,842 and is manufactured by TSI, Inc. as, by way of example, Electrospray Aerosol Generator Model 3480. This device generates small, highly charged liquid droplets and accelerates them through a small orifice into a neutralization chamber where their high charge states are reduced by a radioactive (bipolar) neutralizer. The liquid droplets contain dissolved materials or suspended solid particles. As soon as the droplets are generated they begin drying such that when they enter the neutralization chamber they have dried to solid particles.

The charge fraction of particles after passing through the neutralization chamber is determined by the size of the final dried particles, hence the smaller the particle is, the lower the charged fraction. Since the charged particles are used for subsequent analysis, achieving higher charge fractions or allowing a higher proportion of droplets generated by the electrospray device to be neutralized before they are lost would be advantageous.

SUMMARY OF THE INVENTION

The various embodiments of the invention provide an electrospray generator system that uses a soft X-ray source instead of a radioactive source to generate bipolar ions for the neutralization of the initially charged particles. In this example embodiment, the soft X-ray source is directed at an orifice from which the charged particles emanate. This allows the neutralization of the particles to happen faster than in prior art configurations and in some instances even neutralization occurs immediately on a droplet before it passes through the electrospray orifice. The various embodiments of the invention improve output charged particles with low charge state (e.g. ~one charge per particle) of electrospray aerosol generator. An advantage of the electrospray aerosol generator taught herein is a compact design that eliminates structural parts in using a soft X-ray neutralizer component in a "head on" orientation that increases usable droplet output. In a related embodiment, the "head on" orientation includes a blocking or shielding member, disposed in front of the capillary tube generating droplets, that prevents the soft X-ray irradiation from disrupting the electric field around the end of the capillary tube (which can lead to a condition of corona discharge).

In one example embodiment, an apparatus for generating aerosols is provided that includes an electrospray assembly, having an electrospray inlet and a discharge outlet, for receiving a liquid sample at the electrospray inlet and electrostatically generating multiple substantially uniformly sized electrically charged droplets of the liquid sample at the discharge outlet, the electrospray assembly further including an electrospray chamber with a blocking or shielding member located adjacent and not in contact with the discharge outlet. The apparatus further includes a mechanism for supplying the liquid sample to the electrospray assembly and a charge neutralizing assembly disposed in a head-on or co-linear configuration with the discharge outlet for reducing the electrical charge of each droplet of the liquid sample as the droplet exits the electrospray assembly, wherein the neutralizing assembly comprises a soft X-ray source. The blocking member of the electrospray assembly advantageously prevents an output of the soft X-ray source from impinging directly onto the source of the electrically charged droplets. In a more specific embodiment, the discharge outlet comprises a capillary tube that forms a cone jet configuration at an exit of the tube from the liquid sample, wherein the stability of the cone jet of the liquid sample is maintained by the blocking member thereby facilitating continuous formation of droplets. In yet another related embodiment, the electrospray device includes an evaporation or electrospray chamber defining a droplet evaporation region proximate the electrospray discharge outlet and extending downstream thereof, for reducing the size of the droplets by evaporation as the droplets progress downstream through the evaporation region, to form an aerosol of the sample, wherein the liquid sample comprises an electrically conductive liquid and a substantially non-volatile material uniformly dispersed throughout the liquid, and wherein the aerosol includes particles of a substantially non-volatile residue consisting essentially of the non-volatile material.

The novel features of the various embodiments the invention itself, both as to its construction and its method of operation, together with additional advantages thereof, will be best understood from the following description of specific embodiments when read in connection with the accompanying drawings.

BRIEF DESCRIPTION OF THE DRAWINGS

Other important advantages of the invention will be apparent from the following detailed description of the invention taken in connection with the accompanying drawings in which.

DETAILED DESCRIPTION OF THE INVENTION

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Figure 1:
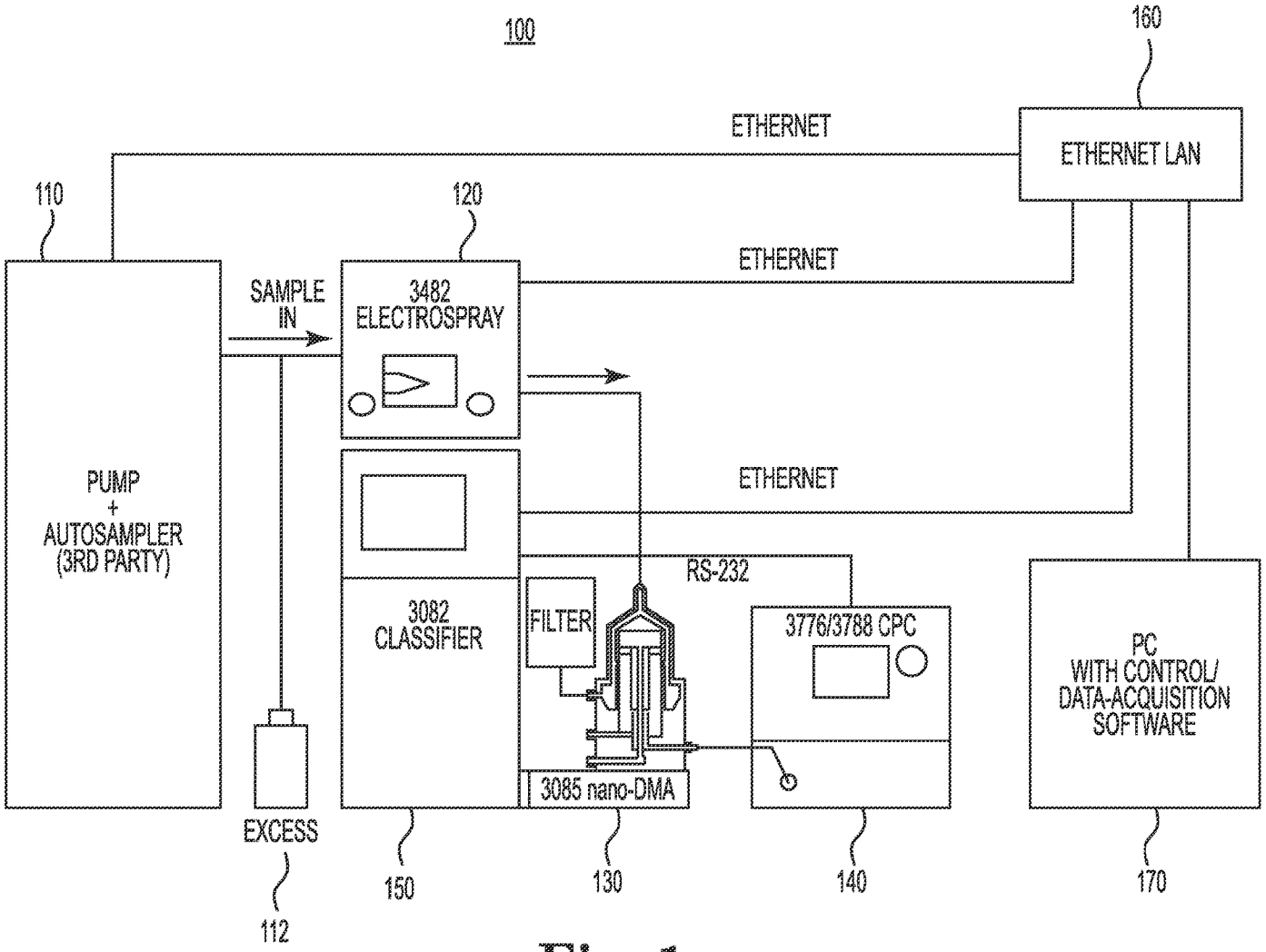
FIG. 1 is a schematic view of an electrospray generator system with a pump and autosampler device, coupled with a Scanning Mobility Particle Sizing (SMPS) system in accordance with the invention.
Figure 2:
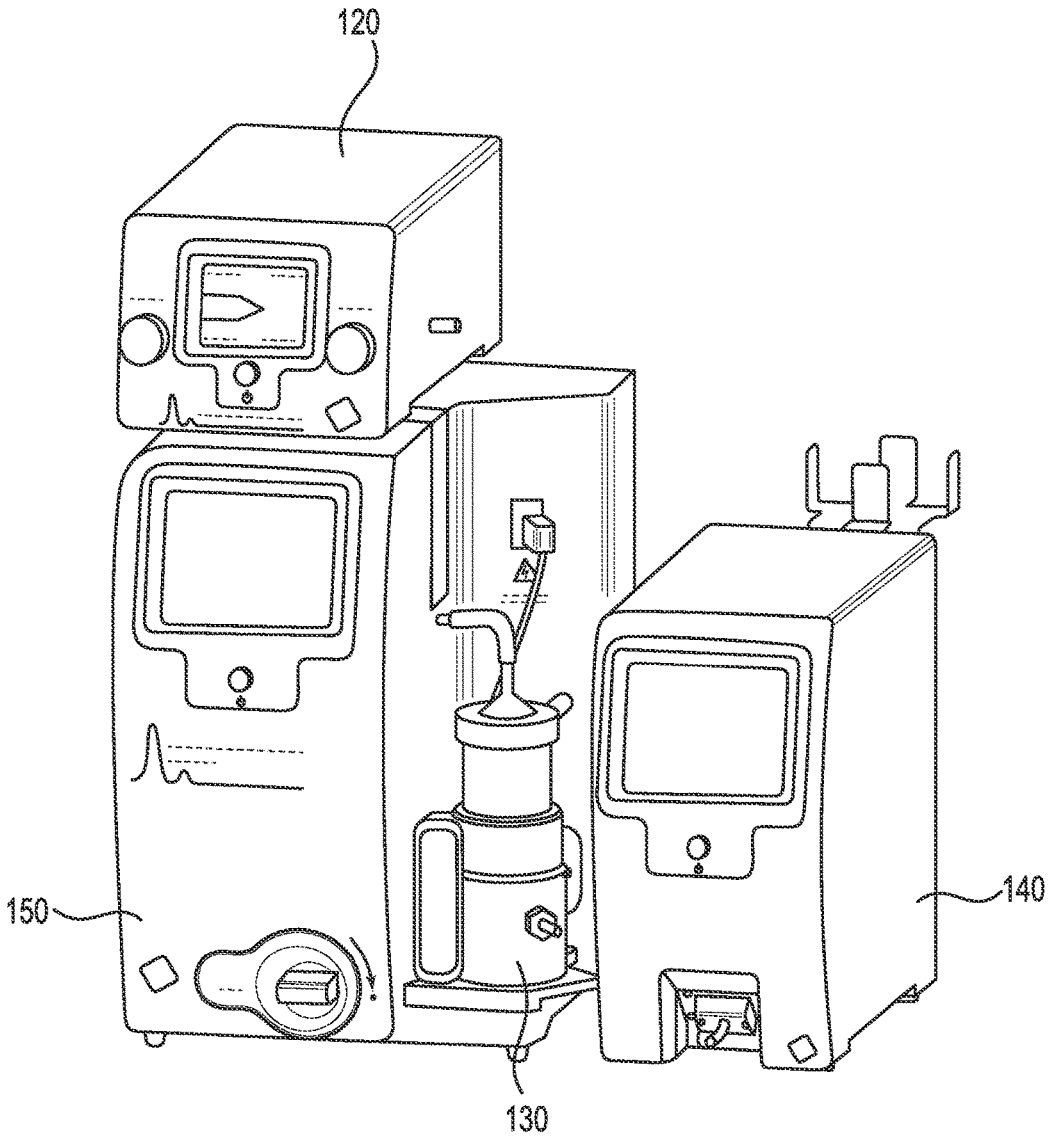
FIG. 2 is an electrospray system without a pump and autosampler device in accordance with an example embodiment of the invention.

Referring now to the figures, and in particular FIGS. 1 and 2, there is illustrated a schematic and pictorial view, respectively, of an electrospray generator system 100 in accordance with the invention. In this example embodiment, electrospray system 100 includes a pump and autosampler assembly 110 for automated liquid delivery of a sample to be analyzed. Assembly 110 directs a sample into an electrospray apparatus 120 configured for aerosol generation with any excess sample being captured by a vessel 112. In this example embodiment, an electrospray of droplets is directed to a nano-DMA 130 (differential mobility analyzer; TSI Model 3085), which is controlled by an electrostatic classifier 150 (such as a TSI Model 3082), for sizing the particles of which are directed to a CPC 140 (condensation particle counter). CPC 140 can either be a butanol-based device (TSI Model 3776) or a water-based ultrafine device (TSI Model 3788).

In this example embodiment, CPC 140 also has an RS 232 communications line coupled to classifier 150. Further, in this example embodiment, most of the devices are communicatively connected via an Ethernet line back to an Ethernet LAN 160, which is in turn communicatively connected to a PC with instrument control/data acquisition software 170. The combination of electrostatic classifier, DMA and CPC, along with instrument control/data acquisition software is commonly referred to as a Scanning Mobility Particle Sizer (SMPS, such as a TSI Model 3938).

FIG. 2 illustrates pictorially part of system 100, such as electrospray apparatus 120, nano-DMA 130, CPC 140 and classifier 150. In this example embodiment, electrospray 120 is configured with a non-radioactive soft X-ray neutralizer (not shown) for neutralizing the electrospray droplets. Partial system 100 illustrated herein is compatible with a 3$^{rd}$ party supplied pump and autosampler. In a related embodiment, system 100 includes a camera for viewing of the electrospray output and includes electronic flow measurement capabilities and includes a touch screen.

Figure 3:
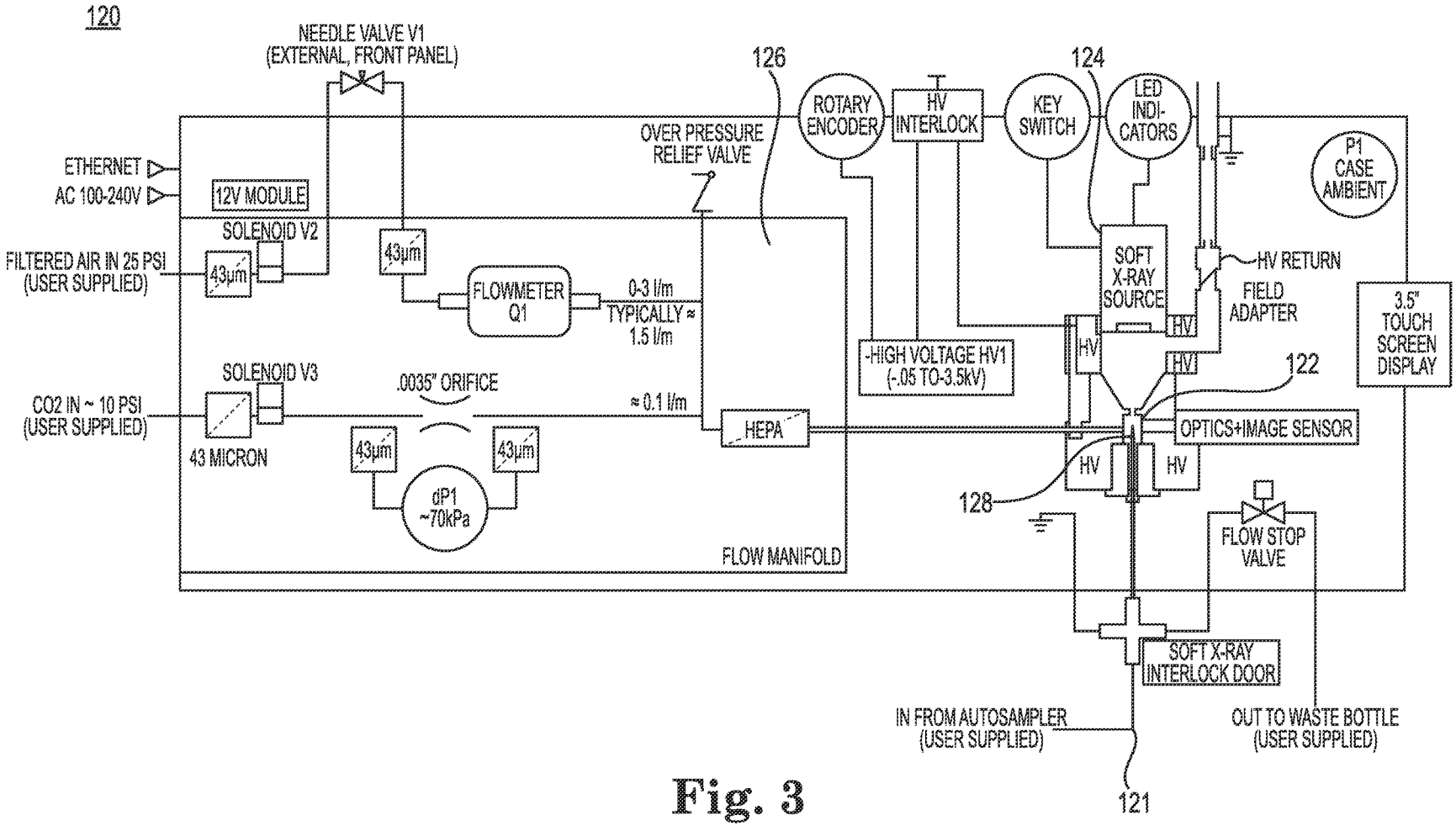
FIG. 3 is a block diagram of the electrospray system in accordance with the invention.

Referring now to FIG. 3 there is illustrated a block diagram of electrospray system 120 in accordance with the invention. In particular, sample liquid from the autosampler flows into electrospray system 120 through an inlet 121 and through an electrospray needle 122 that is in a "head on" configuration with a soft X-ray module 124. An output of electrospray droplets from needle 122 is exposed to soft X-ray radiation from module 124 in a chamber 128 thereby neutralizing the droplets emitted by needle 122. Filtered air is also provided through a flow manifold assembly 126 into chamber 128 in which the droplets are being neutralized. Ethernet and power connections to system 120 are also illustrated.

Figure 4:
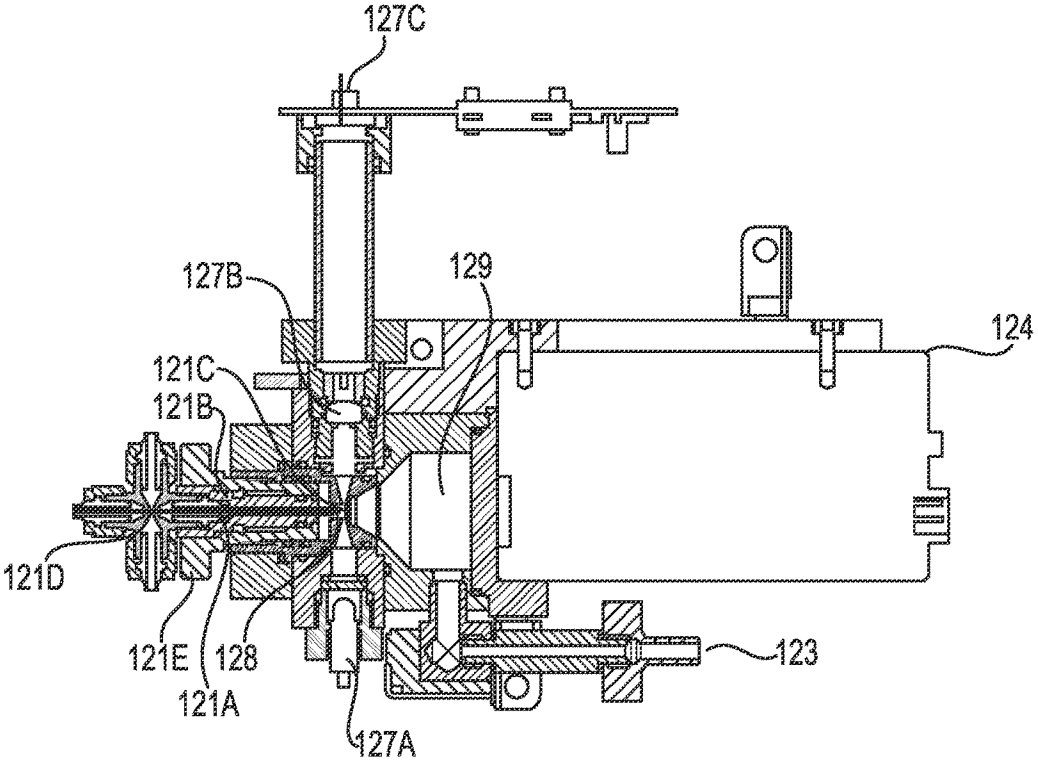
FIG. 4 is a cross sectional top view of an electrospray engine in accordance with the invention.
Figure 5:
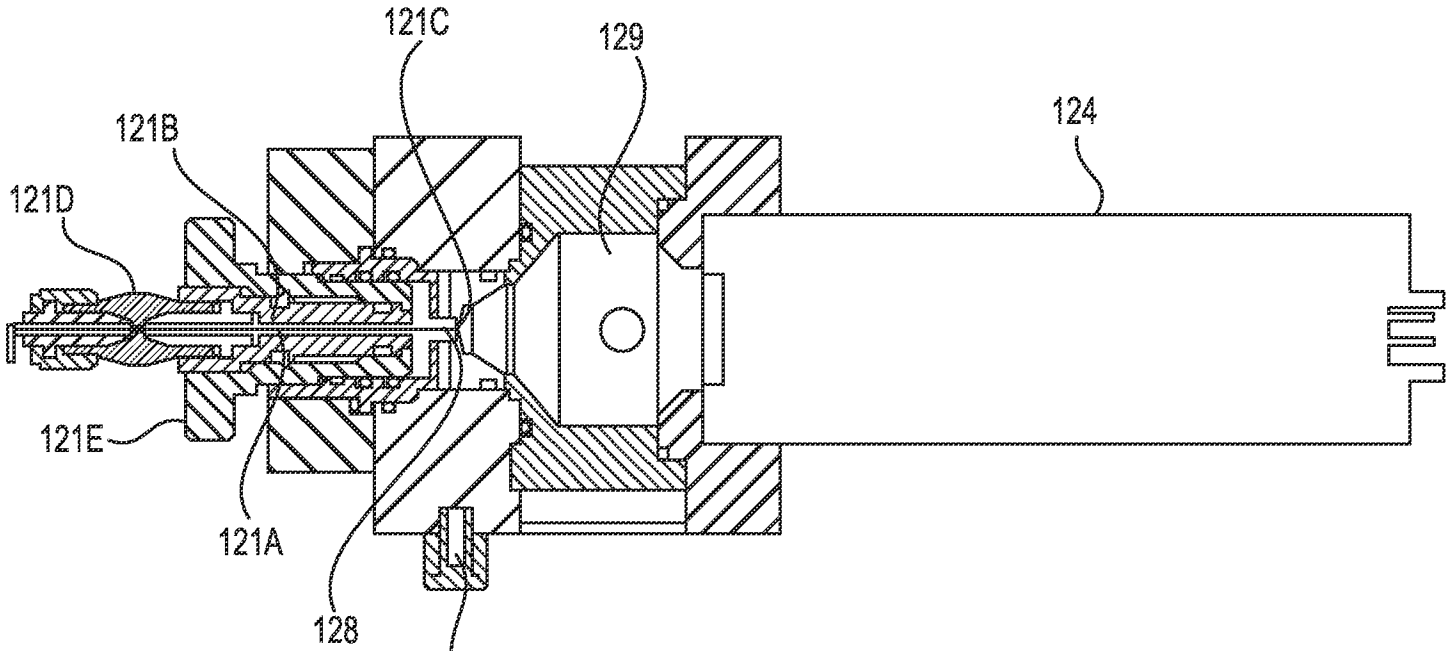
FIG. 5 is a cross sectional side view of an electrospray engine in accordance with the invention.

Referring now to FIGS. 4 and 5, there are shown cross sectional top and side views, respectively, of an electrospray engine 120A of electrospray system 120 in accordance with the invention. In this example embodiment, a TSI 3482 Advanced Electrospray Aerosol Generator uses a soft X-ray neutralizer oriented in a "head-on" configuration, similar to more recent configurations, but different than being oriented perpendicular to the electrospray orifice as in prior generations of electrospray devices. Unlike similar collinear configurations, the invention described herein uses a blocking or shielding member (discuss in detail further down in this application) and others in the art have recognized the performance issues when only a collinear configuration is used (e.g., Liu and Chen (2014) "An electrospray aerosol generator with X-ray photoionizer for particle charge reduction". Journal of Aerosol Science. 76, 148-162). In addition, these prior collinear configurations appear to use a significantly larger orifice or inlet (such as our inlet 121C) into the neutralization chamber than in the electrospray device described herein.

Referring specifically again to FIGS. 4 and 5, in this example embodiment, a capillary tube 121A serving as an electrospray needle and coupled to a liquid flow split tee 121D is held in place by a capillary tube holder 121B (and adjustable with a capillary adjustment knob 121E) such that an aerosol inlet 121C is formed that is directed through an electrospray (or evaporation) chamber 128 through to a neutralization chamber 129. While the droplets are in the neutralization chamber, soft X-ray module 124 emits X-rays and neutralizes any charges on the droplets. This configuration facilitates a smaller footprint and eliminates unnecessary parts, such as filtering plates, and increases the efficiency of producing neutralized particles that are produced by this arrangement. In this example embodiment, an LED backlight 127A, camera optics 127B and an image sensor 127C are also included for viewing and inspection of electrospray stability.

In operation, liquid flows through capillary tube 121A while a clean sheath of air flows around the tip of tube 121A. Meanwhile, an electric field pulls the liquid out from the tube forming a cone jet. Thereafter, liquid droplets of about 150 nm in diameter containing particles shear off the tip of the cone. The droplets are initially very highly charged, upon which the neutralizer reduces the charge of the droplets (in this example embodiment, by soft X-ray irradiation). The charge-neutralized droplet then dry, leaving charge-neutralized nanoparticles.

Figure 6B:
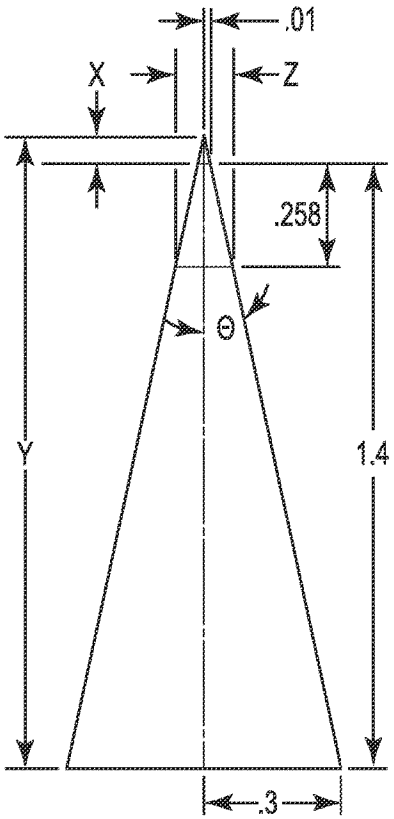
FIGS. 6A and 6B are a cross sectional top view and a schematic, respectively, of an electrospray engine with a radiation blocking feature in a neutralization chamber in accordance with the invention.
Figure 6A:
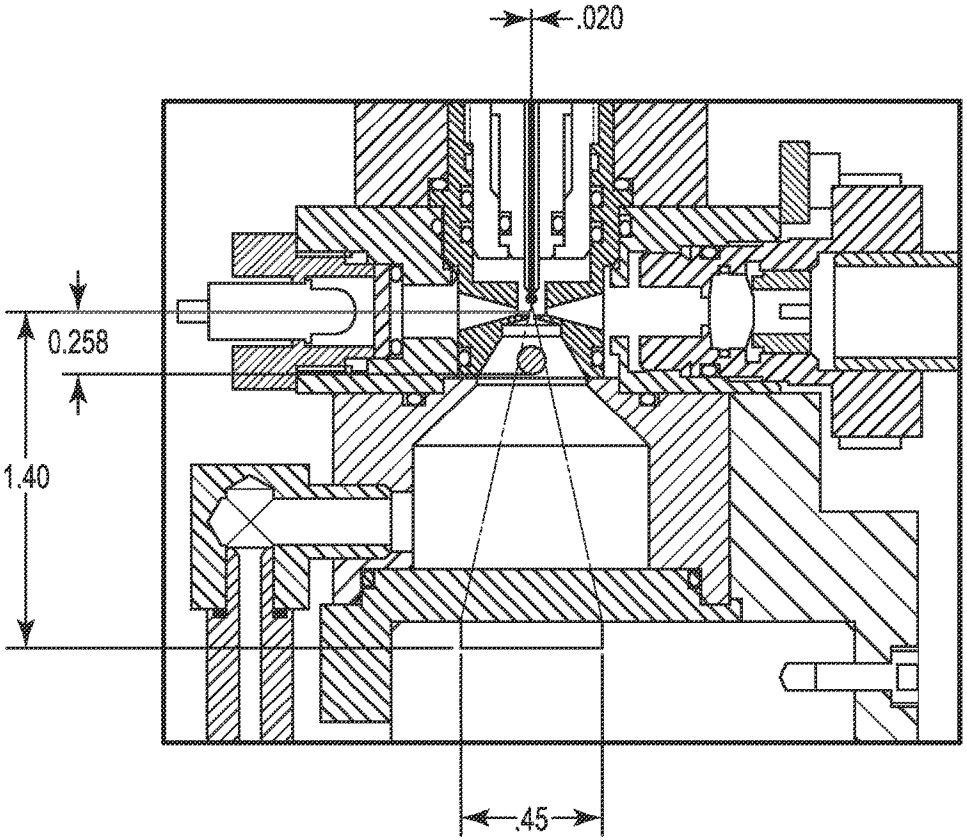

Referring now to FIGS. 6A and 6B, there are illustrated a cross sectional top view and a schematic, respectively, of an electrospray engine 120B with a radiation blocking member 128A in neutralization chamber 129 in accordance with the invention. The various components of this example embodiment are similar to the embodiment illustrated in FIG. 4 with the exception of the radiation blocking member 128A, which in this example embodiment acts to block soft X-rays from impinging directly on the droplets formed from the cone jet and the end of the capillary tube. It was determined in some applications that the direct impinging of soft X-ray irradiation on or towards the tip of the capillary tube (or stream of droplets) would tend to ionize air molecules around the exit of tube 121A, thereby disrupting the electric field around the cone jet leading to an unstable cone jet (and to a corona discharge condition). By adding a blocking or shield member 128A inside the electrospray chamber 128, in this example embodiment, which is spaced from the end of tube 121A and the cone jet, the soft X-ray waves that would normally impinge on the droplets directly are disrupted sufficiently to avoid the soft X-rays from disrupting the electric field around the end of the capillary tube. In this example embodiment, blocking member 128A is a rod or a bar member.

Referring to FIG. 6B, an important element in the design and placement of blocking member 128A is determining the value of Z, which is theoretically a minimum 0.1 inches but is still an effective diameter for the shield/baffle/blocking member. In a preferred embodiment, we use a diameter of about 0.125 inches (or larger than this for a factor of safety and performance). A dimension X from the electrospray orifice plate to the blocking member (the shorter dimension on the left; in inches) is provided as well as a dimension from the electrospray orifice plate to the soft X-ray source (the longer dimension on the left; in inches). Measurements of soft X-ray intensity without blocking member in the electrospray chamber were at about 5.0 μSv/hr, while the soft X-ray intensity with the blocking member were at about 0 μSv/hr. Therefore, the stability of the cone jet of the liquid sample is maintained by the blocking member thereby facilitating continuous and uninterrupted formation of droplets discharged by the capillary tube.

The following patents and publications are incorporated by reference in their entireties: U.S. Pat. Nos. 5,247,842; 7,522,703; 7,796,727; and *Soft X-ray charger (SXC) system for use with electrospray for mobility measurement of bio-aerosols*. Journal of Electrostatics, 69(4), 357-364, Modesto-Lopez, L. B., Kettleson, E. M., & Biswas, P. (2011).

The foregoing specific embodiments of the present invention as set forth in the specification herein are for illustrative purposes only. Various deviations and modifications may be made within the spirit and scope of the invention without departing from the main theme thereof.

What we claim is:

1. An apparatus for generating aerosols comprising:

an electrospray assembly, having an electrospray inlet and a discharge outlet, for receiving a liquid sample at the electrospray inlet and electrostatically generating multiple substantially uniformly sized electrically charged droplets of the liquid sample at the discharge outlet, the electrospray assembly further including an electrospray chamber with a blocking or shielding member located adjacent and not in contact with the discharge outlet;

a mechanism for supplying the liquid sample to the electrospray assembly; and a charge neutralizing assembly disposed in a head-on or co-linear configuration with the discharge outlet for reducing the electrical charge of each droplet of the liquid sample as the droplet exits the electrospray assembly, wherein the neutralizing assembly comprises a soft X-ray source, wherein the blocking member prevents an output of the soft X-ray source from impinging directly onto the source of the electrically charged droplets.

2. The apparatus of claim 1 wherein the discharge outlet comprises a capillary tube that forms a cone jet configuration at an exit of the tube from the liquid sample, wherein the stability of the cone jet of the liquid sample is maintained by the blocking member thereby facilitating continuous formation of droplets.

3. The apparatus of claim 1 further comprising:

an evaporation chamber defining a droplet evaporation region proximate the electrospray discharge outlet and extending downstream thereof, for reducing the size of the droplets by evaporation as the droplets progress downstream through the evaporation region, to form an aerosol of the sample; and wherein the liquid sample comprises an electrically conductive liquid and a substantially non-volatile material uniformly dispersed throughout the liquid, wherein the aerosol includes particles of a substantially non-volatile residue consisting essentially of the material.

4. The apparatus of claim 1 further including a particle counting apparatus disposed downstream of the neutralizing assembly to receive the aerosol.

5. The apparatus of claim 4 wherein the particle counting apparatus is a condensation particle counter.

6. The apparatus of claim 4 further comprising a particle separation device disposed downstream of the neutralization assembly to receive the aerosol and separate particles of the aerosol based upon the electrical mobility of the individual particles.

7. The apparatus of claim 6 wherein the particle separation device comprises an electrostatic classifier.

8. The apparatus of claim 4 further including a particle analyzing device disposed downstream of the evaporation region to receive the aerosol.

9. The apparatus of claim 8 wherein the particle analyzing device includes an electrostatic classifier receiving the aerosol and a condensation particle counter disposed downstream of the electrostatic classifier.

10. The apparatus of claim 1 wherein the blocking member includes one of a bar member having a diameter greater than 0.1 inches or a plate member having a width greater than 0.1 inches.

* * * * *